US008852063B2

(12) United States Patent
Bua et al.

(10) Patent No.: US 8,852,063 B2
(45) Date of Patent: Oct. 7, 2014

(54) HUMERUS-STABILIZED SHOULDER STRETCH DEVICE

(75) Inventors: Alesandro A. Bua, Randolph, NJ (US); Michael R. Dunne, Lyndhurst, NJ (US)

(73) Assignee: Bua Dunne Enterprise, LLC, Randolph, NJ (US)

( * ) Notice: Subject to any disclaimer, the term of this patent is extended or adjusted under 35 U.S.C. 154(b) by 332 days.

(21) Appl. No.: 13/118,341

(22) Filed: May 27, 2011

(65) Prior Publication Data

US 2011/0294634 A1 Dec. 1, 2011

Related U.S. Application Data

(60) Provisional application No. 61/350,383, filed on Jun. 1, 2010.

(51) Int. Cl.
*A63B 71/00* (2006.01)
*A61H 1/02* (2006.01)

(52) U.S. Cl.
CPC ..... *A61H 1/0281* (2013.01); *A61H 2201/0192* (2013.01); *A61H 2201/1253* (2013.01); *A61H 2201/1676* (2013.01); *A61H 2201/0153* (2013.01); *Y10S 482/907* (2013.01)
USPC ..... 482/139; 482/907

(58) Field of Classification Search
USPC ..... 482/44–46, 51, 124, 139, 148, 482/907–908, 91, 92, 131, 133–138; 602/5, 602/20–22, 60–64
See application file for complete search history.

(56) References Cited

U.S. PATENT DOCUMENTS

| | | | | |
|---|---|---|---|---|
| 2,415,288 | A * | 2/1947 | Jordan | 602/20 |
| 4,569,519 | A * | 2/1986 | Mattox et al. | 482/114 |
| 4,899,735 | A * | 2/1990 | Townsend et al. | 602/20 |
| 5,352,174 | A | 10/1994 | Mason et al. | |
| 5,391,132 | A * | 2/1995 | Greenwald | 482/91 |
| 5,520,615 | A | 5/1996 | Fontana et al. | |
| 5,558,624 | A | 9/1996 | Hepburn et al. | |
| 5,776,083 | A | 7/1998 | Jacob et al. | |
| 5,919,148 | A * | 7/1999 | Marko et al. | 600/595 |
| 6,129,650 | A | 10/2000 | Wedge, Jr. | |
| 6,497,640 | B2 * | 12/2002 | Loft et al. | 482/115 |

(Continued)

OTHER PUBLICATIONS

What is the Rotater?, http://therotater.com/wp/the-rotater/what-is-the-rotater/ (printed May 27, 2011).

(Continued)

*Primary Examiner* — Loan H Thanh
*Assistant Examiner* — Gregory Winter
(74) *Attorney, Agent, or Firm* — Weitzman Law Offices, LLC

(57) ABSTRACT

A humerus-stabilized shoulder stretching device including a first rod, gripping handle coupled to the first rod, force handle, and stationary arm having a first portion and a second portion oriented relative to each other by an angle. The first portion of the stationary arm is coupled to the gripping handle by the first rod and the force handle is coupled to stationary arm via the second portion. An elbow cradle having a base coupled to the stationary arm is configured to accommodate a user's arm such that when the user's elbow is within the elbow cradle and the user grips the gripping handle with the hand of that arm, the user's forearm will be releasably constrained between the gripping handle and the elbow cradle and the distance between the base and the gripping handle will be maintained by the first rod at a length approximately equal to the user's forearm.

21 Claims, 10 Drawing Sheets

(56) References Cited

U.S. PATENT DOCUMENTS

| | | | | |
|---|---|---|---|---|
| 6,569,067 | B1 * | 5/2003 | Madole | 482/148 |
| 6,689,030 | B1 | 2/2004 | Leslie | |
| 6,824,498 | B2 * | 11/2004 | Hassler | 482/1 |
| 6,929,616 | B2 * | 8/2005 | Bonutti et al. | 602/20 |
| 7,357,761 | B2 | 4/2008 | Mattox | |
| 7,364,555 | B1 | 4/2008 | Davidson | |
| 7,578,747 | B2 | 8/2009 | Reilly | |
| 7,717,834 | B2 | 5/2010 | Kay | |
| 7,976,444 | B2 * | 7/2011 | Binns et al. | 482/114 |
| 2004/0087419 | A1 * | 5/2004 | Ware et al. | 482/93 |
| 2004/0259698 | A1 | 12/2004 | Reilly | |
| 2007/0099780 | A1 | 5/2007 | Bowser | |
| 2007/0129224 | A1 * | 6/2007 | Karafa | 482/123 |
| 2007/0225620 | A1 | 9/2007 | Carignan et al. | |
| 2008/0079230 | A1 | 4/2008 | Graham | |
| 2008/0312053 | A1 | 12/2008 | Kay | |
| 2010/0234776 | A1 | 9/2010 | Borden | |

OTHER PUBLICATIONS

The Rotator Female Instructions, http://therotater.com/instructions/female_instructions.pdf (printed May 27, 2011).

The Rotator Male Instructions, http://therotater.com/instructions/male_instructions.pdf (printed May 27, 2011).

* cited by examiner

HUMERUS-STABILIZED SHOULDER STRETCH DEVICE

CROSS REFERENCE TO RELATED APPLICATION

This application claims benefit of U.S. Provisional Application No. 61/350,383, filed Jun. 1, 2010, the entirety of which is incorporated herein by reference.

BACKGROUND

1. Field

This disclosure relates generally to exercise, and, more particularly, to device-assisted stretching of the shoulder.

2. Background

Shoulder stretching exercises may be used to aid in rehabilitation and/or prevention of injury to the shoulder. Shoulder stretching exercises may restore range of motion, joint mobility, and muscle elasticity in the shoulder after suffering from any of a variety of shoulder injuries, such as acromioclavicular joint injuries, dislocations, fractures, impingement, rotator cuff injuries, adhesive capsulitis, subacromial bursitis, etc. Shoulder stretches may also be used to prepare the shoulder for physical activity. Stretching increases circulation to the shoulder, and ensures that the muscles and tendons in the shoulder are limber for activity, thereby possibly preventing injury.

BRIEF SUMMARY

In one aspect of this disclosure, a humerus-stabilized shoulder stretching device is disclosed. The device includes a first rod, a gripping handle coupled to the first rod, a force handle, and a stationary arm having a first portion and a second portion oriented relative to each other by an angle. The first portion of the stationary arm is coupled to the gripping handle by the first rod and the force handle is coupled to stationary arm via the second portion. An elbow cradle having a base is coupled to the stationary arm and configured to accommodate a user's arm such that when the user's elbow is within the elbow cradle and the user grips the gripping handle with the hand of that arm, the user's forearm will be releasably constrained between the gripping handle and the elbow cradle and the distance between the base and the gripping handle will be maintained by the first rod at a length approximately equal to the user's forearm.

In another aspect of this disclosure, a method of humerus-stabilized shoulder stretching is disclosed. The method is performed using a device having a gripping handle coupled to a first rod, the first rod coupled to a stationary arm, an elbow cradle on the stationary arm and a force handle coupled to the stationary arm. The method includes releasably constraining a user's forearm in the device between the elbow cradle and the gripping handle of the device such that the user's elbow is within the elbow cradle and a portion of the gripping handle is wrapped by the user's palm such that a distance between the gripping handle and the elbow cradle substantially corresponds to the user's forearm length and movement of the user's forearm is inhibited relative to the first rod without being secured to the first rod, and using the force handle of the device to manipulate the shoulder complex corresponding to the arm of the of the user that is releasably constrained by the device.

The foregoing generally outlines features of one or more embodiments in order that the following detailed description and the advantages to be achieved therefrom may be better understood. The advantages and features described herein are a few of the many advantages and features available from representative embodiments and are presented only to assist in understanding the invention. It should be understood that they are not to be considered limitations on the invention as defined by the claims, or limitations on equivalents to the claims. For instance, some of these advantages are mutually contradictory, in that they cannot be simultaneously present in a single embodiment. Similarly, some advantages are applicable to one aspect of the invention, and inapplicable to others. Thus, this summary of features and advantages should not be considered dispositive in determining equivalence. Additional features and advantages of the invention will become apparent in the following description, from the drawings, and from the claims.

BRIEF DESCRIPTION OF THE DRAWINGS

This disclosure is further described in the detailed description that follows, with reference to the drawings, in which.

DETAILED DESCRIPTION

Figure 1:
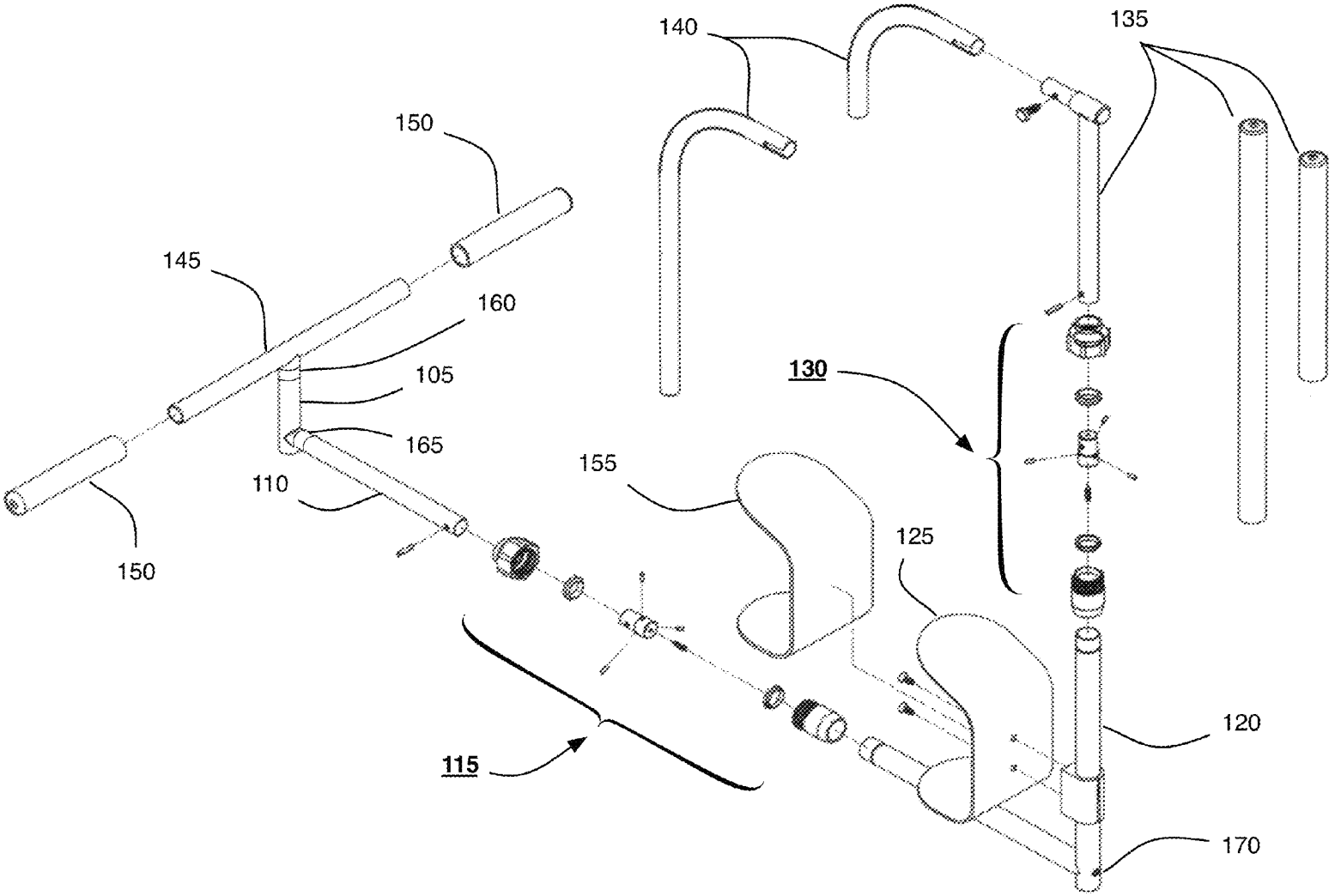
FIG. 1 is an exploded view of the humerus-stabilized shoulder stretching device.

This application discloses a humerus-stabilized shoulder stretching device and an associated method of use. In overview, this humerus-stabilized shoulder-stretching device improves the effectiveness of active and active-assistive stretching of the shoulder complex by isolating the shoulder complex. The device generally has a gripping handle, one or more telescoping rods, an elbow cradle and a force handle. The gripping handle, telescoping rods, and elbow cradle collectively releasably constrain the forearm of the arm to be stretched within the device so that the forearm is fixated between the elbow cradle and gripping handle but is not secured to the device. The user may then use the force handle to position the arm in a variety of shoulder stretching positions. Advantageously however, the releasable constraint approach to fixating the arm ensures that if the user experiences pain, they can easily and quickly extricate themselves from the device merely by releasing their hand from the grasping handle and moving their arm. Moreover, with this device, shoulder stretching is improved by the isolation of the shoulder complex from other joints during the stretching process. The humerus-stabilized shoulder-stretching device may also provide appropriate upper extremity positioning for performing these stretches. Furthermore, the device allows appropriate glide and roll of the shoulder complex during the stretching exercises.

The humerus-stabilized shoulder stretching device may be used to aid in a variety of stretching exercises of the shoulder, including (but not limited to) external rotation in zero degrees of abduction in supine position, external rotation in ninety degrees of abduction in supine position, external rotation in ninety degrees of abduction in standing position, internal rotation in ninety degrees of abduction in supine position, internal rotation in zero degrees of abduction in standing position, internal rotation in ninety degrees of abduction in standing position, and forward flexion in the plane of the scapula. By way of illustrative, non-limiting example, any of the stretches described and illustrated in connection with FIGS. 3A-10B of U.S. Pat. No. 7,717,834, incorporated herein by reference, may be performed with one or more of the variant humerus-stabilized shoulder stretching devices described herein, although the device of U.S. Pat. No. 7,717,834 requires that the palm on the arm attached to the device be in a "palm up" or "palm down" position, whereas the instant device does not.

Turning now to the figures, FIGS. 1-4 illustrate one example embodiment of the humerus-stabilized shoulder-stretching device 100. As shown, device 100 generally includes a gripping handle 145, one telescoping rod 110, a fastener 115, a stationary arm 120 (having two portions oriented at an angle relative to each other), an elbow cradle 125, another fastener 130, another telescoping rod 135 and a force handle 140.

Figure 2:
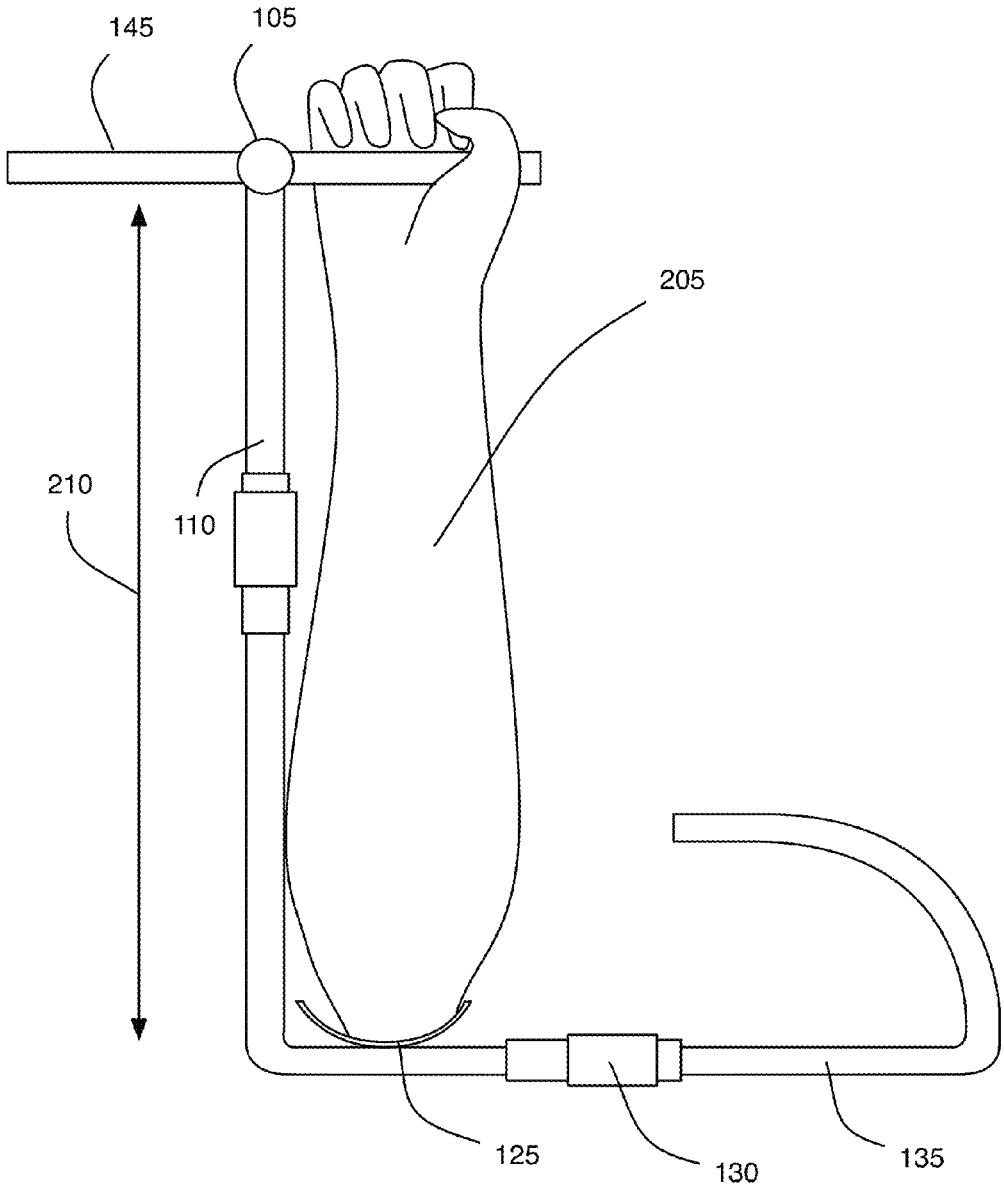
FIG. 2 is a side perspective view of the humerus-stabilized shoulder stretching device of FIG. 1.

The gripping handle 145, telescoping rod 110, fastener 115 and elbow cradle 125 may be utilized in combination to releasably constrain a user's forearm 205 in the device 100, for example, as shown in FIG. 2. Note here that the "releasably" is intended to refer to the user's grasp keeping them in the device, not some mechanical means of affixation of the arm to the device. In other words, the arm is primarily constrained by the combined placement of the elbow in the elbow cradle and the grasping of either the gripping handle 145 or the alternative gripping handle 105 described below. To accomplish this releasable constraint, the user grabs the gripping handle 145 and places their elbow within the elbow cradle 125. The telescoping rod 110 is then adjusted until the length 210 between the gripping handle 145 and the elbow cradle 125 essentially matches the length of user's forearm 205, thereby preventing unwanted movement in the elbow, forearm, or wrist and isolating the upper portion of the user's arm, while allowing the user to extricate themselves from the device merely by letting go and moving their arm (i.e. they are not attached to the device, for example, by a strap that needs to be removed).

The telescoping rod 110 is formed as a straight rigid rod of any appropriate cross sectional shape, but shown here for purposes of illustration as a cylindrical rod which can be solid or of hollow cross section. The telescoping rod 110 is preferably affixed to or part of the same structure as an alternative gripping handle 105, although as described below, it can be made detachable or adjustable as well. The alternative gripping handle 105 preferably extends away from the telescoping rod 110 at about a ninety-degree angle. Similarly, the alternative gripping handle 105 and the gripping handle 145 are preferably aligned at about a ninety-degree angle relative to each other. This may advantageously accommodate users in grasping the alternative gripping handle 105 and gripping handle 145, although, with other embodiments, other angles may be used as desired or required.

Figure 4:
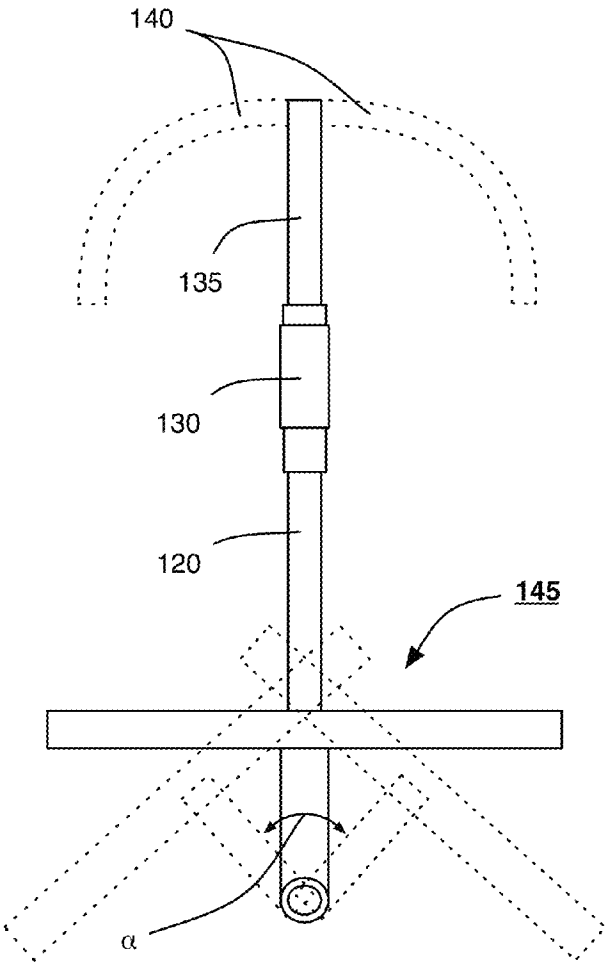
FIG. 4 is a top elevation view of the humerus-stabilized shoulder stretching device of FIGS. 1-3.
Figure 3:
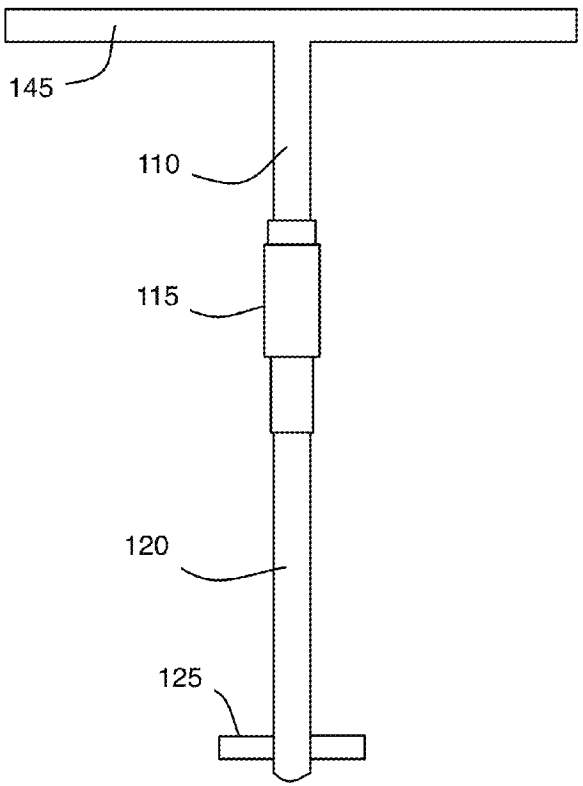
FIG. 3 is a front perspective view of the humerus-stabilized shoulder stretching device of FIGS. 1 and 2.

The alternative gripping handle 105 and/or the gripping handles 145 provide the primary grip positions for the user. As with the telescoping rod 110, the alternative gripping handle 105 and the gripping handles 145 may all be formed as predominantly straight rods of appropriate cross sectional shape, which may be, for example, the cylindrical rods shown. They may be formed as an integrated whole, or formed separately as individual pieces, and then joined via some suitable process (such as via a threaded connection, compression fitting, gluing or welding, etc.) capable of reliably establishing the connection in a permanent or temporary manner as required. Any suitable material may be used to form the telescoping rod 110, the gripping handles 145 and the alternative gripping handle 105. In one example embodiment, the gripping handles 145 and the alternative gripping handle 105 are secured to the telescoping rod 110 which, in turn, can be locked into place using the fastener 115. As described in more detail below, the fastener 115 can optionally be configured to not only allow for axial movement of the telescoping rod 110 relative to the coaxial portion of the stationary arm, but to also allow it to rotate about the axis of that same portion of the stationary arm 120, for example, through an arc alpha ("$\alpha$") as depicted in FIG. 4). This allows the handles 105, 145 to be swiveled relative to the stationary arm 120, allowing the user more freedom in establishing a comfortable grip before the telescoping rod 110 is locked into place relative to the stationary arm 120 prior to use.

In general, using lightweight and strong materials for the components of the device 100 is preferable due to the stresses that can be applied during use. Therefore, strong plastic composites or lightweight metals, such as aluminum, may be desirable. For example, the telescoping rod 110, gripping handle 105 and alternative gripping handles 145 may be formed as hollow aluminum rods joined by welding. Alternatively, where portability is a desirable feature, these components can be made detachable (using for example, threads, clips or any other fastening approach that will maintain a fairly strong and rigid connection between them, the particular type of connector being a matter of design or manufacturing choice and unimportant to forming an understanding of the device 100 itself).

It is contemplated that the device 100 can be provided in any of several different sizes. For example, the device could be configured to accommodate users spanning from children to adults. Alternatively, a given device could be configured for use with a specific segment of people, for example, one size embodiment configured to be adjustable as described herein to primarily accommodate adult users, another size embodiment being configured to primarily accommodate children, and another size embodiment being configured for use with adolescent youths. Similarly, the intended users can influence the materials, rigidity and sizing of the device components given that a device solely for children can be lighter, smaller and less rigid than one intended for adult males due to significant differences in user strength and size.

Advantageously, in this regard, the telescoping rod 110 may be provided in any of a number of different lengths to accommodate different ranges of adjustability. For example, a shorter rod of about eight inches, to provide for a range of adjustability for an overall length of between about 8 inches to about 16 inches, may benefit pediatric users, while a longer rod of about thirty inches, to provide for a range of adjustability (measured from the intersection point of the two portions making up the stationary arm 120 to the distal end of the telescoping rod 110) of between about 14 inches to about 30 inches (measured as above), may be better suited for the adult population. As noted above, the device 100 described herein can be scaled in size to accommodate different user populations, so variations in length may be used to accommodate those populations as desired, with the understanding that the goal is to have the adjusted length, measured as noted above, approximately match the length of the user's forearm. In addition, depending upon the particular implementation, the rod 110 can be configured so that it can be locked into various specific different lengths or it can be configured for adjustment to any length in between a specified minimum and maximum (referred to herein as "infinite" adjustability).

Like the telescoping rod 110, the other telescoping rod 135 may also be formed as a straight rod of similar cross sectional shape, such as a cylindrical rod and may be provided in different lengths, for example, a shorter rod of about eight inches to accommodate pediatric users or a longer rod of about thirty inches for the adult population. Again, any variation of sizes and/or lengths may be used to accommodate the desired user population.

The gripping handles 145 may also be covered with a cushion material 150. The cushion material 150 covers the surface of the gripping handles 145 and provides a variety of benefits, depending on the material used. The cushion material 150 may be provided for comfort, or to increase friction and grip, etc. The cushion material 150 may be formed of any suitable or desirable material, such as but not limited to rubber, plastic, cloth, etc., depending on the attributes desired and/or the intended user population. The thickness of the cushion material 150 may also vary. For example, thicknesses of one-quarter inch to three inches may be desirable for a foam-based covering, whereas a cloth covering might be less than one-quarter inch. Furthermore, the cushion material 150 can be removable and disposable after use. This may aid in maintaining hygienic use of the humerus-stabilized shoulder-stretching device 100.

As described above, the outer diameter of the telescoping rod 135 is preferably smaller than the inner diameter of a hollow stationary arm 120 to allow the telescoping rod 135 to extend and retract into the stationary arm 120. Another fastener 130, similar to (or of a different style from) the fastener 115 above secures the telescoping rod 135 to the stationary arm 120 when a desired length has been achieved. Again, depending upon the particular implementation, the fastener 130 can optionally allow for rotational movement of the telescoping rod 135 in addition to, or instead of, axial movement relative to the stationary arm 120.

The stationary arm 120 provides a base for the humerus-stabilized shoulder-stretching device 100. The stationary arm 120 receives both the telescoping rod 110 in one portion and the other telescoping rod 135, in the other portion (note that the cross sections of the portions may be different from each other, as can the corresponding telescoping rods). The stationary arm 120 is preferably cylindrical and hollow or of a cross-sectional shape that corresponds to the shape of the telescoping rods 110, 135, and in the case of a cylindrical shape, having an inner diameter greater than the outer diameter of the telescoping rods 110, 135. The larger inner cross sections of the stationary arm 120 accommodates the smaller cross sections of the telescoping rod 110 and the telescoping rod 135, so that either can retract into the body of stationary arm 120. The stationary arm 120 comprises about a ninety-degree bend between the two portions such that the telescoping rods 110, 135 are positioned at about right angles to one another, although other angles may be utilized as appropriate or desirable. The stationary arm 120 is similarly formed of a lightweight and strong material such as those described herein for the telescoping rods.

As noted above, fasteners 115, 130 may be used to secure the rods 110, 135 to the stationary arm 120 when the desired adjustment has been achieved. Notably, any fastener capable of allowing for axial and/or the optional rotational movement of a rod 110, 135 relative to the stationary arm 120 may be used as either fastener 115, 130. By way of example, one style of fastener is shown in FIG. 1, a conventional compression ring fastener, and it is used to secure a rod 110, 135 to the stationary arm 120. As shown, the example compression ring-based fastener 115 and fastener 130 of FIG. 1 are each made of a male collet, female collet and compression ring. In one example, the male collet is coupled to one telescoping rod 110 or the other telescoping rod 135 (allowing the telescoping rod to slide through it), and the female collect is affixed to the stationary arm 120. Of course the female and male portions could be reversed. The female collet and male collet are threaded together to compress the compression ring housed within. When the female collet and male collet are tightened to a sufficient level of torque, tapered surfaces inside the female and/or male collet compress the compression ring, which is tightened in turn against the surface of their telescoping rod. The resulting friction between the compressed compression ring and the telescoping rod should be sufficient to prevent the telescoping rod from moving relative to the stationary arm 120. In general, in addition, a pin, groove, stop or other mechanical device is also used, during axial movement, to prevent the telescoping rods 110, 135 from escaping the inner hollow of the stationary arm 120.

Alternatively, in a simple example, instead of the compression ring-based fasteners 115, 130, the fasteners could consist of a simple bolt threaded into the body of the stationary arm 120 which, when tightened secures the rods 110, 135 from movement. To secure a telescoping rod 110, 135, the bolt is tightened until a bottom surface of the bolt contacts the telescoping rod 110, 135 such that the resulting friction between the bolt and the rod 110, 135 prevents movement of the rod 110, 135 relative to the stationary arm 120 or, alternatively, until the bolt engages a suitably threaded opening or depression in the rod 110, 135. Similarly, a bolt and slot arrangement can be used if rotation is not desired. However, as noted above, any fastening mechanism may be used to implement either or both fastener 115 and fastener 130 as desired.

An elbow cradle 125 is affixed to the stationary arm 120. The elbow cradle 125 may be shaped or otherwise molded to comfortably support the user's elbow. For example, the elbow cradle 125 may have a parabolic shape so as to support the bottom of the user's elbow while providing some lateral support as well. Other shapes which provide more lateral support may be used as desired or suitable. The elbow cradle 125 may be formed from any material, however use of a strong lightweight material is preferable. Therefore, strong lightweight metals, such as aluminum, composites or plastics may be used for the elbow cradle 125. For example, an aluminum elbow cradle 125 may be created flat, and then bent to create the parabolic shape described above. Alternatively, the elbow cradle 125 can be molded or formed by joining multiple pieces of different shapes. The elbow cradle 125 may be affixed to the stationary arm 120 via mechanical fasteners such as screws, bolts or rivets, glue, welding, or any other suitable or desirable method. As shown in FIG. 1, the elbow cradle is fixed in the "neutral" position.

Figure 9A:
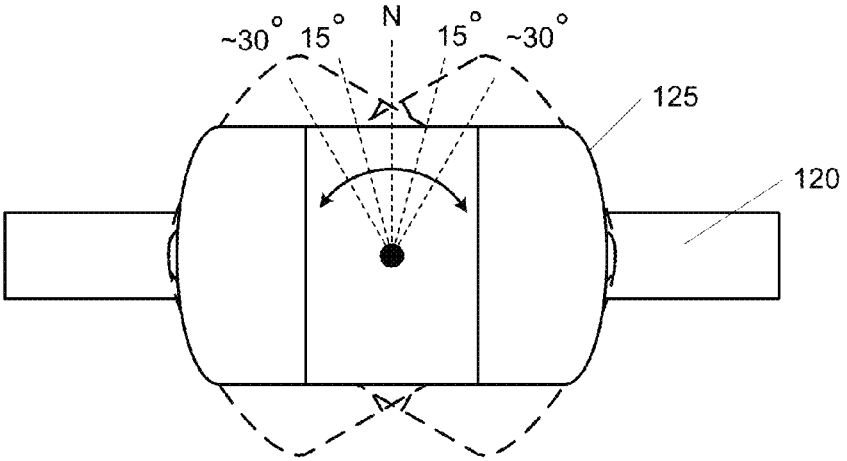
FIGS. 9A through 9D illustrate, in simplified form, example variant positionable elbow cradles that rotate, pivot or swing.
Figure 9B:
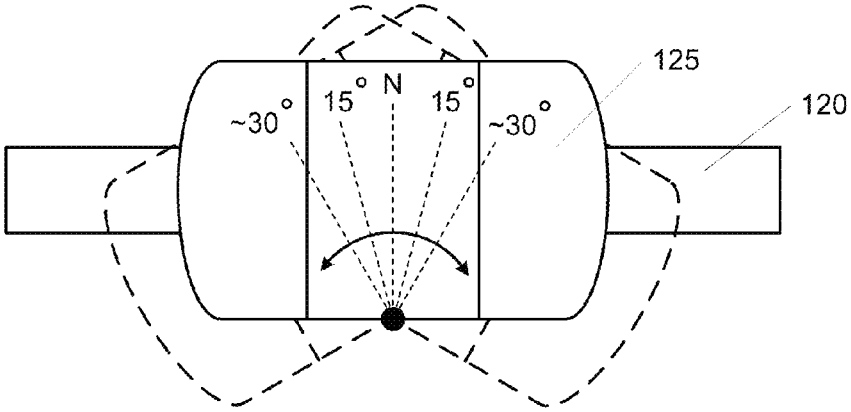
Figure 9C:
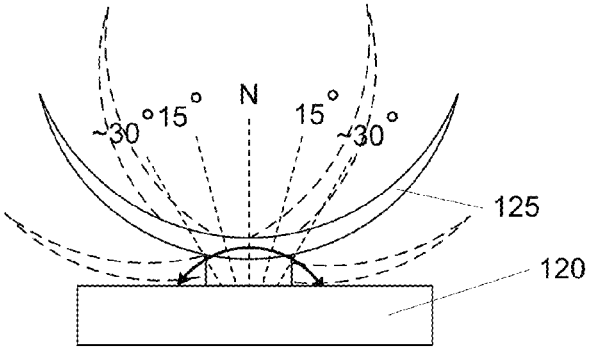
Figure 9D:
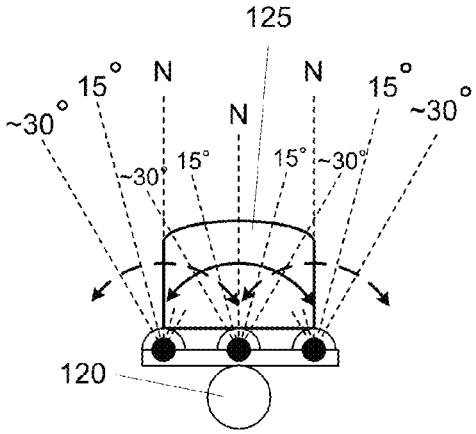

Optionally, the elbow cradle 125 can also be configured such that it can rotate, swing or pivot about its center or a point on the elbow cradle 125 other than its center, relative to the stationary arm 120. These individually optional variants are shown in FIGS. 9A, 9B, 9C and 9D. Depending upon the particular implementation, the ability and degree of rotation, swing or pivot will be controlled or maintained by a release and lock mechanism of any suitable design, the design and implementation of specific mechanisms for such movement being conventional. Some appropriate mechanisms may be configured to allow for movement anywhere within the allowable range, whereas others may allow rotation, swing or pivot in only one direction or only to predefined positions within the overall possible arc. For example, as shown in FIG. 9A, the elbow cradle 125 can be moved about its center from the neutral position to a maximum position of about 30 degrees from the neutral position to one, or optionally both, sides, in the latter case being moveable through a total arc of about 60 degrees. Alternatively, the elbow cradle 125 can be asymmetrically moveable such that the maximum amount of movement off of the neutral position is different depending upon whether movement is to the left or right. In other words, even if the total allowable arc was about 60 degrees, the movement could be constrained such that, for example, maximum movement in one direction is about 15 degrees, whereas in the other direction the maximum movement is about 45 degrees. The same is true for optional movement about a point other than the center of the elbow cradle 125 such as shown in FIG. 9B, as well as for movement about the axis of the stationary arm portion to which the base is attached such as shown in FIG. 9C or for angular movement in a plane through the axis of the stationary arm portion to which the base is attached about some point on, and typically below, the elbow cradle. In addition, the elbow cradle 125 can be configured such that the spacing between the lateral sides can be increased or decreased via adjustment to accommodate different elbow widths. Any conventional mechanical mechanisms suitable for providing this adjustment capability can be used. Alternatively, depending upon the particular implementation, the material that the elbow cradle 125 is to be made of can provide this adjustability if it is fairly rigid but deformable, for example, aluminum or another metal or alloy.

As with the handles and rods, the elbow cradle 125 may vary in length and angulations. For example, longer length may improve the stability of the user's elbow in the elbow cradle 125. A tip-to-tip length for the elbow cradle 125 (i.e. lengthwise along the surface surrounding the elbow) may generally be from about ten to about twelve inches. Of course, other lengths may be utilized as required or desired. The angulations of the surfaces that form the elbow cradle 125 may also be varied. A range of smaller angles (such as about thirty degrees) to larger angles (such as about one hundred degrees) measured from a plane through the stationary arm that bisects the elbow cradle 125 may be utilized depending on the level of support desired, and the setting in which the device 100 is to be used.

Optionally, the elbow cradle 125 may be equipped with an elbow cradle cushion 155 which can be used to provide a comfortable surface for seating a user's elbow or to provide a more snug fit. The elbow cradle cushion 155 is preferably molded to a substantially similar shape as the elbow cradle 125. Like the cushion modifications 150, the elbow cradle cushion 155 may be formed from any material having the desired properties. For example, rubber or foam may be utilized to provide extra tactile grip and provide a more comfortable, pliant surface for the user's elbow. Varying thicknesses may be used to increase or decrease the cushioning or snugness of fit of the elbow cradle 125.

The force handle 140 is used to execute device-assisted stretching of the shoulder complex. In use, once the forearm of the user is releasably constrained between the gripping handle or alternative gripping handle and the elbow cradle, the force handle 140 is used to manipulate and stretch the shoulder complex by moving the humerus-stabilized shoulder-stretching device 100 into a variety of stretching positions. As shown, the force handle 140 is formed as a bent cylindrical rod, initially extending perpendicularly away from the second telescoping rod 135. The force handle 140 may then bend radially before terminating in a straight handle portion running roughly parallel to the second telescoping arm 135. The curvature of the force handle 140 may beneficially aid in creating the ideal amount of force to provide the appropriate stretch. As noted above, the second telescoping rod 135 may also be configured to swivel or rotate relative to the stationary arm 120. It should now be appreciated that this can allow the angle of the force handle 140 to be set relative to the humerus-stabilized shoulder stretching device 100 to aid in handling of the device and execution of the desired stretching movement.

As with the first telescoping arm 110 and the stationary arm 120, the force handle 140 is similarly preferably made of lightweight and strong materials as described above. In one implementation, the force handle 140 can be detachable and different shaped force handles can be provided, for example having different curvatures, total lengths and/or arc lengths (as shown in FIG. 1). Alternatively, the force handle 140 can be predominantly or completely straight or angled if desired.

Figure 5:
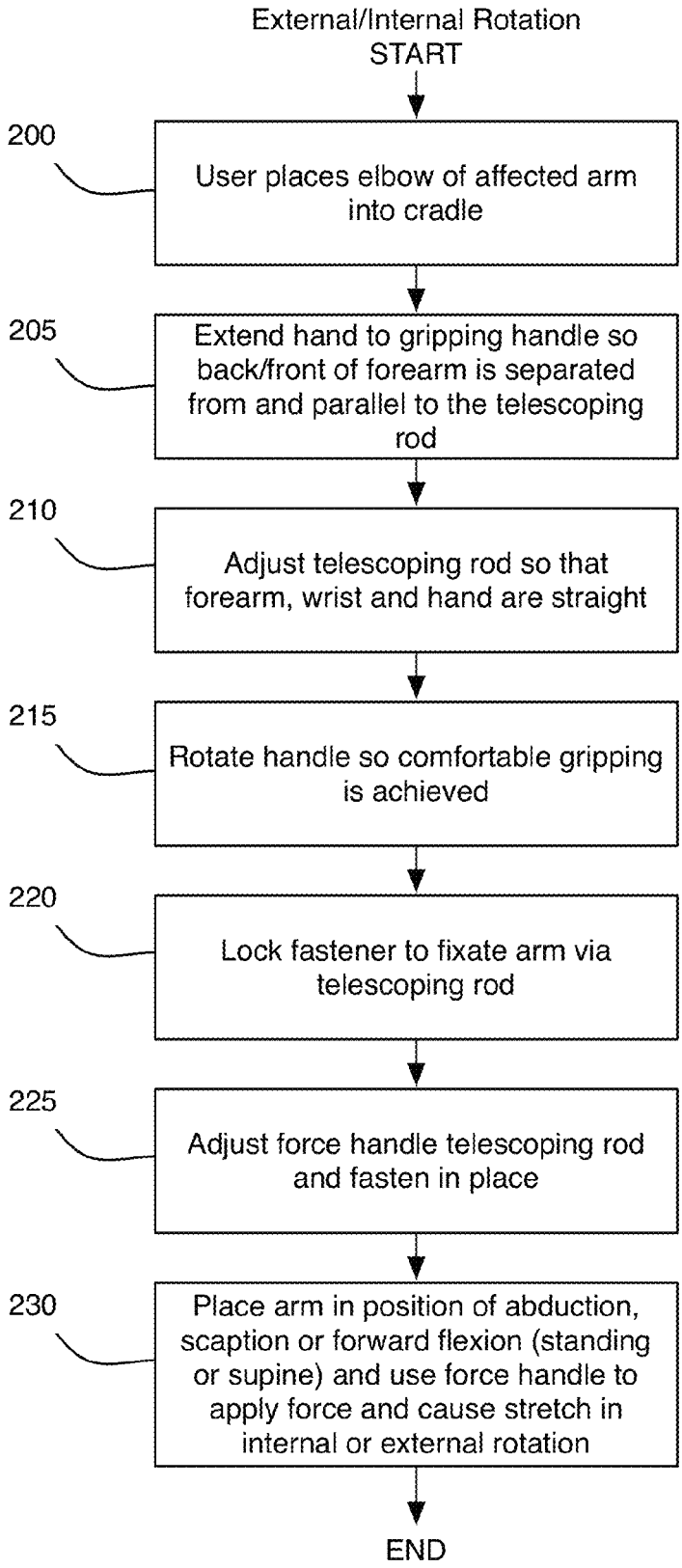
FIG. 5 is a flow chart representing a preferred sequence of steps for using the humerus-stabilized shoulder stretching device of FIGS. 1-4 for an internal or external shoulder stretch.

FIG. 5 is an example flow chart representing how the humerus-stabilized shoulder-stretching device 100 of FIGS. 1-4 can be used for an internal or external shoulder stretch. First, the user places the elbow of the arm to be stretched into the elbow cradle 125 (step 200). Then, the user grips the gripping handle 105 or alternative gripping handle 145 (depending on preference) (step 205). Next, the telescoping rod 110 is adjusted to any appropriate length 210 such that the wrist is unbent and the affected arm will be releasably constrained between the handle 105, 145 and the elbow cradle 125 of device 100 (step 210) when the rod 110 is locked into place. Additionally, if the telescoping rod 110 is rotatable, it may be rotated to further achieve a comfortable grip for the affected arm (step 215). The fastener 115 is then tightened to lock the humerus-stabilized shoulder-stretching device 100 into the desired configuration (step 215). Similarly, if desired or necessary, the length of the other telescoping rod 135 can be adjusted so that the force handle 140 is positioned correctly for the exercise to be performed (step 225) and, if rotation of the force handle 140 is desired, the force handle 140 may also be rotated into the correct position and the fastener 130 tightened, so that the telescoping rod 135 and the force handle 140 are firmly secured. Finally, the user or an aid can manipulate the force handle 140 to force the affected arm into a variety of shoulder-stretching positions (step 230).

Use of this device for various stretching positions and movements, including both external and internal rotations of the shoulder, can provide benefits not achievable with present devices. With the device, users can also place the affected arm in varying degrees of abduction, scaption or forward flexion, depending on the desired level of stretch they are looking to achieve. Naturally, these humerus-stabilized shoulder stretching device 100 aided stretches may all be performed in any one or more of the standing, supine, side-lying, and/or prone position.

Figure 6:
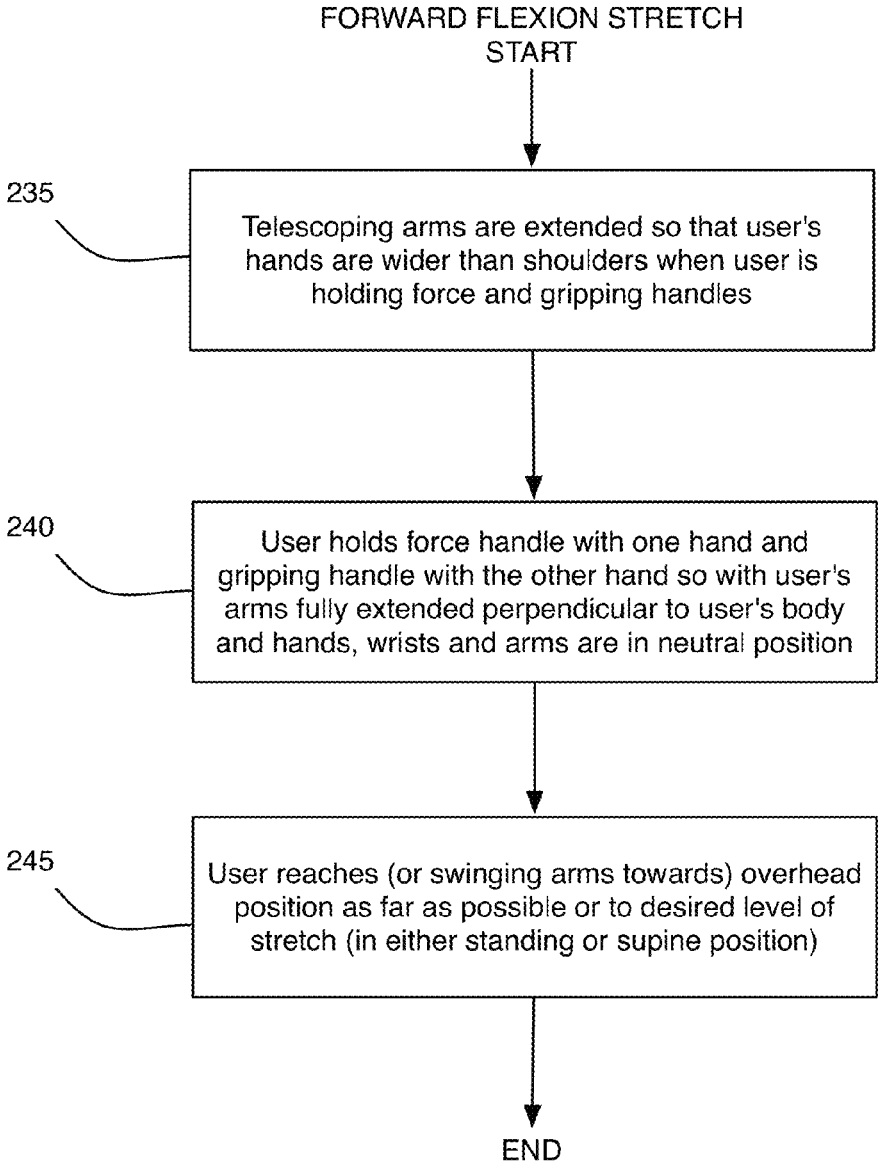
FIG. 6 is a flow chart representing a preferred sequence of steps for using the humerus-stabilized shoulder-stretching device of FIGS. 1-4 for a forward flexion stretch in the plane of the scapula.
Figure 7:
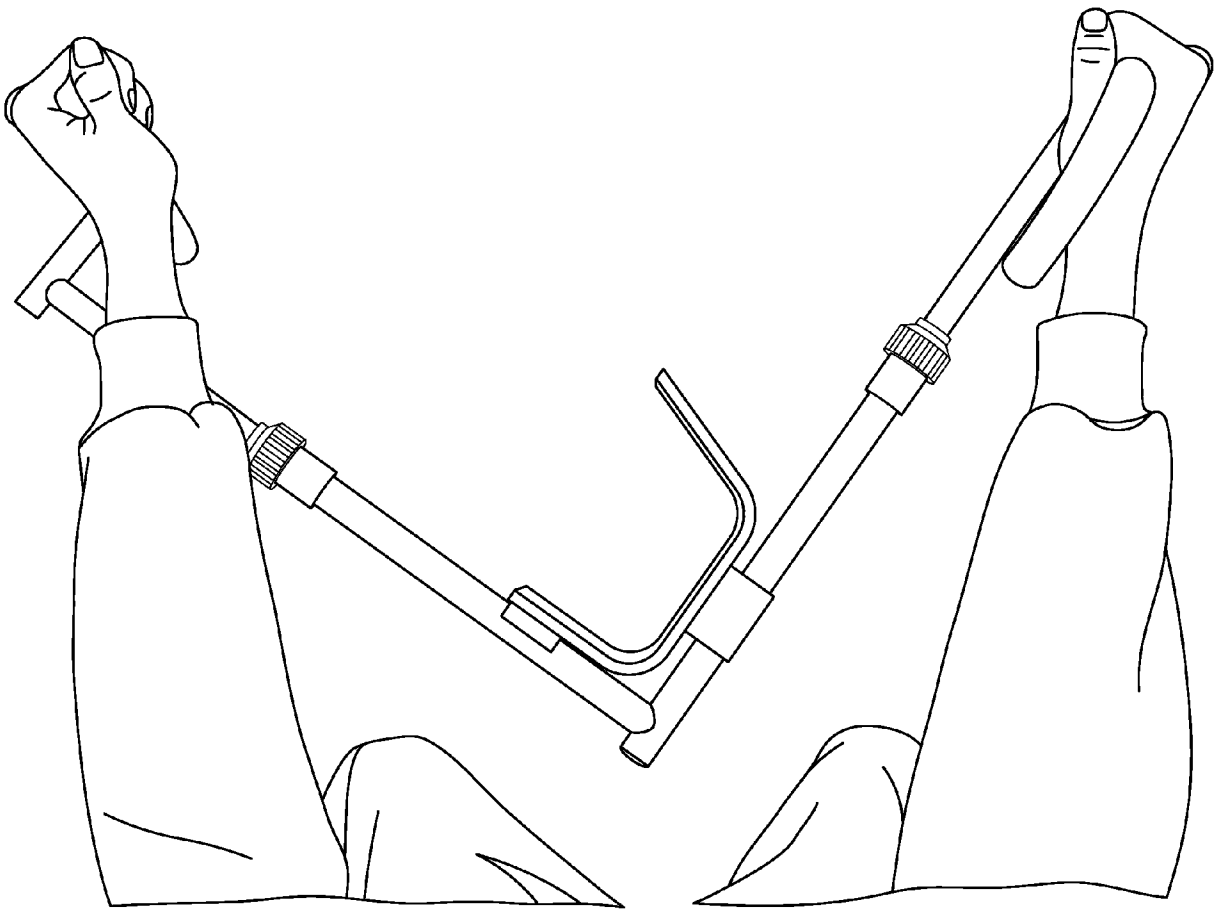
FIGS. 7, 8A, 8B and 8C are images of a user holding the device at points during the forward flexion stretch described in connection with FIG. 6.
Figure 8A:
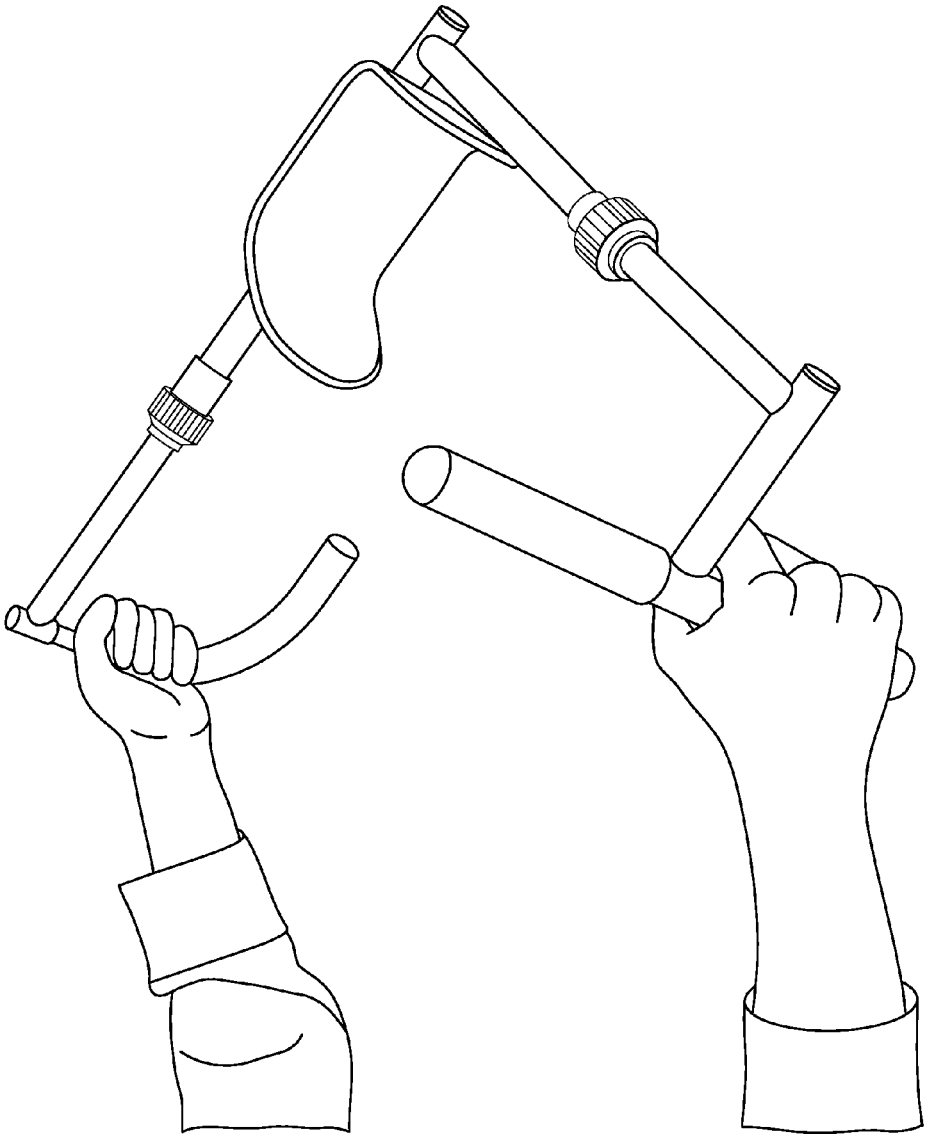
Figure 8B:
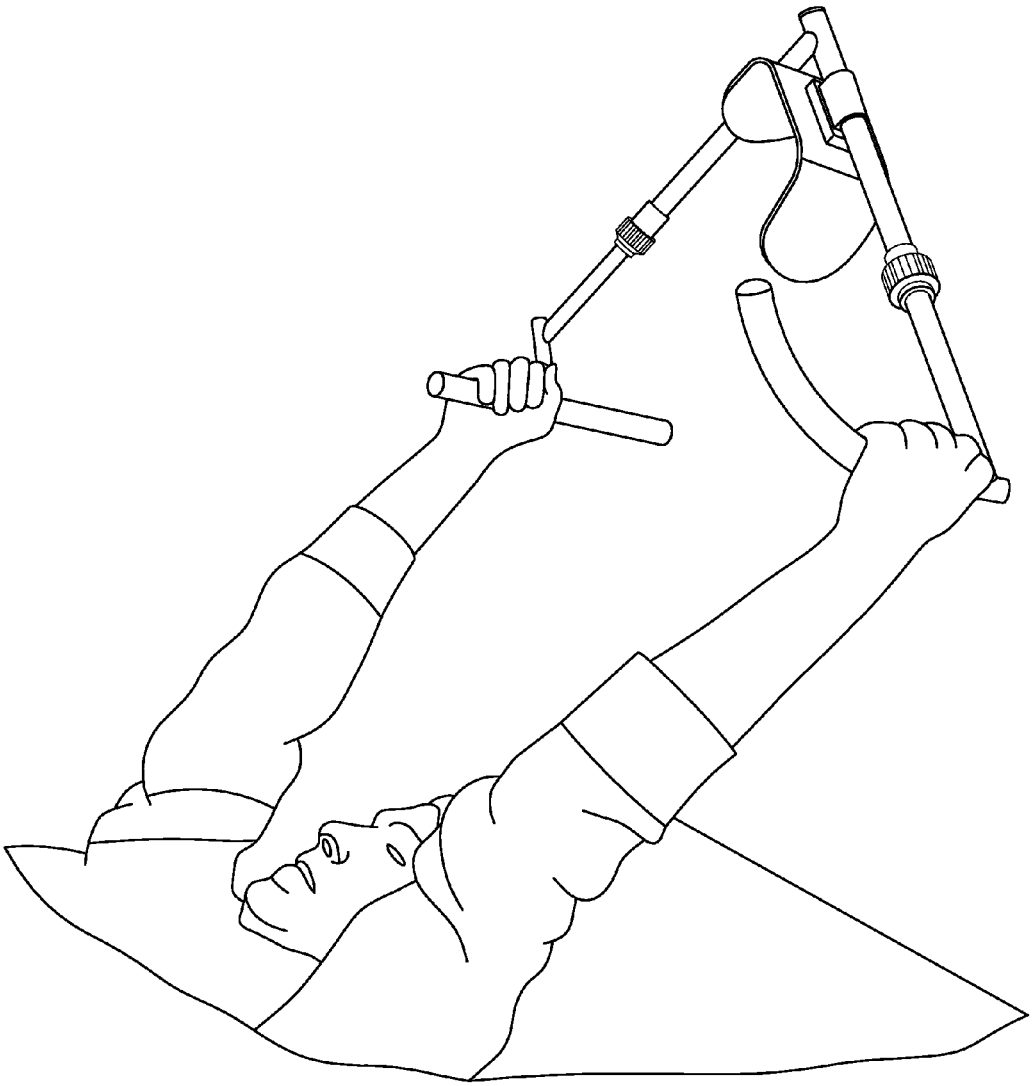
Figure 8C:
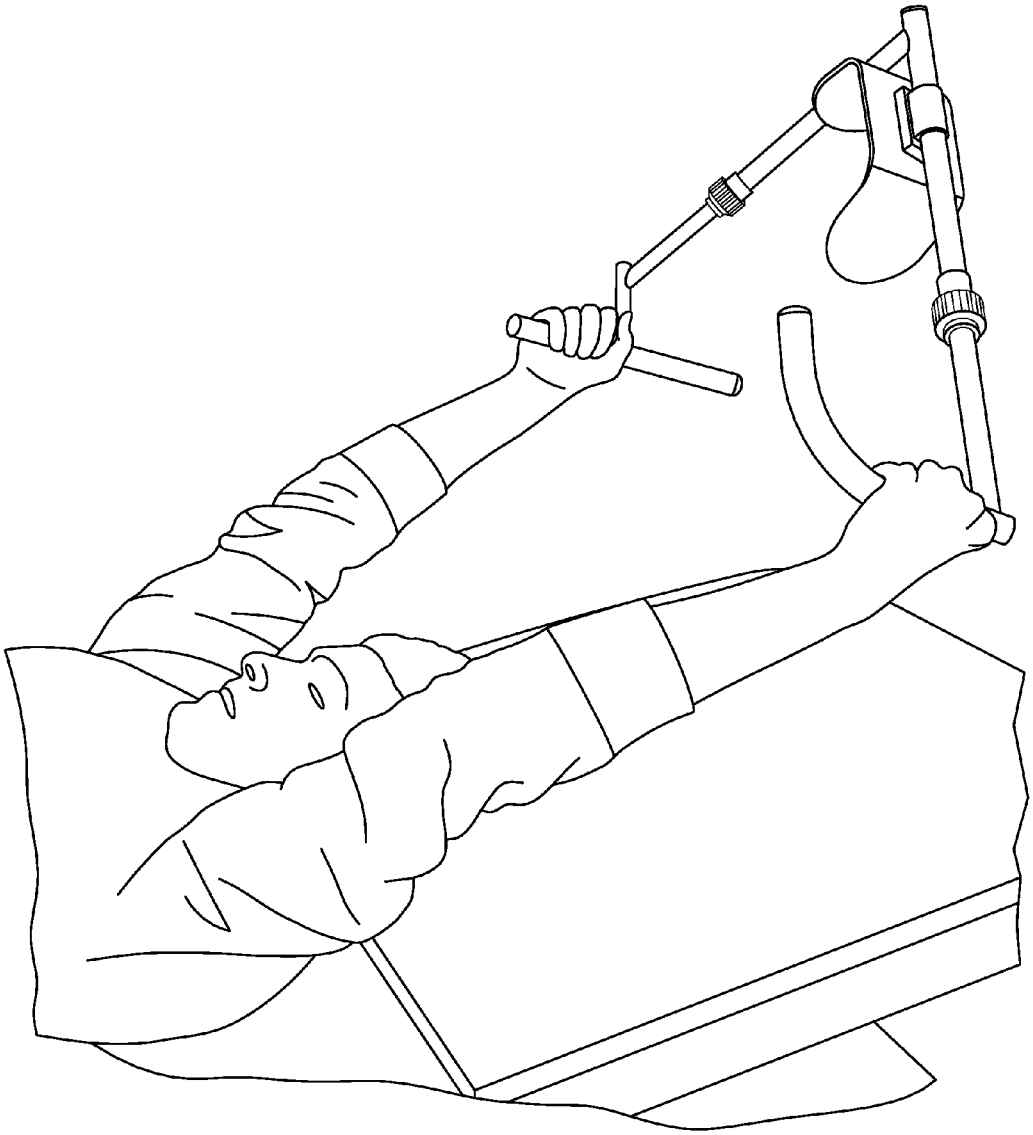

FIG. 6 is a flow chart representing an example sequence of steps for using the humerus-stabilized shoulder-stretching device 100 of FIGS. 1-4 for a forward flexion stretch with FIGS. 7, 8A, 8B and 8C being images of a user holding the device as part of the stretch described in connection with FIG. 6. To prepare for the stretch, the device 100 will be situated so that the angle between the two portions of the stationary arm 120 either point towards the user (such as shown in FIG. 7) or away from the user (FIGS. 8A-8C), with the force handle 140 and gripping handle 105 both adjusted such that they face in the same direction. The telescoping rods 110, 135 are then adjusted to an appropriate length, typically either full extension or, for a smaller user, an extension less than full that situates the user's hands at least slightly wider than their shoulders when the user's arms are fully extended and the hands, wrists and arms of the user are in the neutral position. Then the telescoping rods 110, 135 are locked into position using the fasteners 115, 130 (step 235). To perform the stretch using the device 100, the user holds the humerus-stabilized shoulder stretching device 100 as shown in FIGS. 7, 8A-8C (i.e. with one hand on the force handle 140 and one hand on the gripping handle 105 and the arms fully extended outwardly (step 240)) so that a plane containing the user's arms and the stationary arm 120 are generally perpendicular to the user's body (FIGS. 7, 8A). The user them maintains full arm extension but pivots their arms about the shoulder joints towards their head (towards a position where the user's arms would be in line with their torso) as far as possible or to the desired level of stretch, such as shown in FIGS. 8B and 8C (step 245). As with the other stretches, this stretch may be performed in the supine, standing and/or prone position(s).

At this point, it should be understood that still other variants can readily be constructed without varying from the invention. For example, as noted above, different sizes can be used to accommodate different populations. Moreover, with some implementations, only the first telescoping rod 110 will be length adjustable (i.e. the second telescoping rod 135 may be of fixed, non-adjustable length). Alternatively, the first telescoping rod 110 can be of fixed length, with only the second telescoping rod 135 being length adjustable as described. Note however, that even where one of the rods 110, 135 is of fixed length, a set of different length replacement rods can be provided such that different length arms within a population segment can still be accommodated. In other variants, one or more of the rods 110, 135 and arm 120 can be made of tubing that necessarily inhibits rotation, for example triangular or hexagonal cross section, or the rods 110, 135 can have a different cross sectional shape relative to the cross section of the arm 120, for example, the rods 110, 135 could be of hexagonal or octagonal cross section, whereas the arm 120 could be of round cross section so that the flat areas of the rods 110, 135 can aid in locking. Still further, in some implementations, the connection 160 between the gripping handle 145 and the alternative gripping handle 105 can be made releasable and/or rotationally movable and lockable, for example, for portability, further adjustability, or storage. The same is true for the connection 165 between the rod 110 and the alternative gripping handle 105 and/or for the connection 170 shown in FIG. 1 between the two tubes that are angled relative to each other which collectively make up the arm 120.

Having described and illustrated the principles of this application by reference to one or more preferred embodiments, it should be apparent that the preferred embodiment(s) may be modified in arrangement and detail without departing from the principles disclosed herein and that it is intended that the application be construed as including all such modifications and variations insofar as they come within the spirit and scope of the subject matter disclosed.

What is claimed is:

1. A humerus-stabilized shoulder stretching device, comprising:

a first rod;

a rigid gripping handle coupled to and offset from the first rod;

a force handle;

a stationary arm having a first portion and a second portion oriented relative to each other by an angle, the first portion of the stationary arm being coupled to the gripping handle by the first rod such that the gripping handle can be moved relative to the stationary arm rotationally and also axially, to a length approximately equal to a user's forearm length, and then releasably fixed in position, the force handle being coupled to the stationary arm via the second portion such that the force handle can concurrently be moved both rotationally and axially, relative to the stationary arm, and then releasably fixed in position; and an elbow cradle positioned near the angle and coupled to the stationary arm, such that it has an axis that is angularly offset from a plane defined by the first and second portions of the stationary arm, the elbow cradle comprising a base and sides on either side of and extending away from the base in a direction towards the gripping handle, the elbow cradle and rigid gripping handle being configured to accommodate the user's arm in between the elbow cradle and gripping handle such that, when the user's elbow is within the elbow cradle and the user grips the rigid gripping handle with the hand of that arm, the user's upper arm will be aligned in the axial direction of the elbow cradle and the user's forearm will be releasably constrained by, and between, the gripping handle and the elbow cradle, so that the force handle can be moved to articulate the user's shoulder for the arm that is between the rigid gripping handle and the elbow cradle.

2. The device of claim 1, wherein the offset, taken relative to a perpendicular to the plane, is an angle within the range of about 0 degrees to about 30 degrees.

3. The device of claim 2, wherein the first rod intersects the gripping handle at a right angle.

4. The device of claim 1, wherein the stationary arm comprises a hollow portion configured to receive a portion of the first rod therewithin.

5. The device of claim 1, further comprising a fastener releasably connecting the first rod to the stationary arm so as to concurrently allow for both the rotational movement and the axial movement of the first rod relative to the stationary arm.

6. The device of claim 5, wherein the fastener comprises a compression ring fastener.

7. The device of claim 1, wherein the force handle comprises a curved force handle.

8. The device of claim 7, wherein the curved force handle is movable relative to the stationary arm through an arc of at least 180 degrees.

9. The device of claim 7, wherein the plane is a first plane and wherein a second rod and the curved force handle together define a second plane oriented such that the first plane and second plane either correspond or are parallel to each other with a distal end of the force handle being located on a first rod-side of the stationary arm and directed towards one of the first portion or the first rod.

10. The device of claim 7, wherein the plane is a first plane and a second rod and the curved force handle together define a second plane, and wherein the curved force handle can be positioned such that the first plane and second plane are perpendicular to each other.

11. The device of claim 7, wherein the stationary arm comprises a hollow portion configured to receive a portion of a second rod therewithin.

12. The device of claim 7, further comprising a fastener releasably connecting a second rod to the stationary arm so as to concurrently allow for both the rotational movement and the axial movement of the second rod relative to the stationary arm.

13. The device of claim 12, wherein the fastener comprises a compression ring coupling.

14. The device of claim 1, wherein the angle is about ninety degrees.

15. The device of claim 14, wherein the force handle is at least partially curved.

16. The device of claim 1, further comprising an alternative gripping handle located between the gripping handle and the first rod.

17. The device of claim 16, wherein the gripping handle is releasably secured to the alternative gripping handle.

18. The device of claim 16, wherein the alternative gripping handle is releasably secured to the first rod.

19. The device of claim 1, wherein the elbow cradle is moveable in at least one of a rotational, swing or pivoting manner relative to the stationary arm at a location where the elbow cradle is coupled to the stationary arm.

20. The device of claim 19, wherein the elbow cradle is moveable to a position within an arc of about 30 degrees from neutral.

21. The device of claim 19, wherein the elbow cradle is moveable through an overall arc of between about 30 degrees and about 60 degrees.

* * * * *